US012752170B2

(12) United States Patent
Parke et al.

(10) Patent No.: US 12,752,170 B2
(45) Date of Patent: Oct. 6, 2026

(54) ROTATIONALLY FIXED HOUSING FOR MULTI-AXIS MOTION SENSING, TELEMETRY, PROCESSING AND OTHER ELECTRONIC COMPONENTS OPERABLE TO SECURELY AFFIX TO A GOLF CLUB

(71) Applicant: SkyHawke Technologies, LLC, Ridgeland, MS (US)

(72) Inventors: Gord Parke, Winnipeg (CA); Jeremy Rittenhouse, Lancaster, PA (US); Moses Phinehas Victor, Ridgeland, MS (US)

(73) Assignee: SkyHawke Technologies, LLC

( * ) Notice: Subject to any disclaimer, the term of this patent is extended or adjusted under 35 U.S.C. 154(b) by 451 days.

(21) Appl. No.: 18/392,829

(22) Filed: Dec. 21, 2023

(65) Prior Publication Data

US 2025/0205580 A1 Jun. 26, 2025

(51) Int. Cl.
*A63B 69/36* (2006.01)

(52) U.S. Cl.
CPC .... *A63B 69/3614* (2013.01); *A63B 2220/803* (2013.01); *A63B 2220/805* (2013.01); *A63B 2220/833* (2013.01)

(58) Field of Classification Search
CPC ..... A63B 69/3614; A63B 2220/803; A63B 2220/805; A63B 2220/833; A63B 2220/16; A63B 2225/20; A63B 60/16; A63B 2225/50; A63B 60/46; A63B 69/3632
USPC ..... 473/131, 199, 220, 221, 222, 223, 226, 473/227, 233, 407
See application file for complete search history.

(56) References Cited

U.S. PATENT DOCUMENTS

| | | | | |
|---|---|---|---|---|
| 8,613,676 | B2 * | 12/2013 | Bentley | A63B 60/46 473/316 |
| 8,894,502 | B2 | 11/2014 | Rose | |
| 8,926,444 | B2 | 1/2015 | Kato et al. | |
| 8,992,346 | B1 * | 3/2015 | Raposo | A63B 57/00 473/409 |
| 9,028,337 | B2 | 5/2015 | Bentley | |
| 9,033,810 | B2 | 5/2015 | Bentley | |
| 9,195,781 | B2 | 11/2015 | Savarese et al. | |
| 9,211,455 | B2 | 12/2015 | Savarese et al. | |
| 9,412,979 | B2 | 8/2016 | Yarmis et al. | |
| 9,452,330 | B2 | 9/2016 | Savarese et al. | |
| 9,643,049 | B2 | 5/2017 | Bentley et al. | |
| 9,694,263 | B2 | 7/2017 | Savarese et al. | |
| 9,746,354 | B2 * | 8/2017 | Martin | G06F 3/011 |
| 9,770,639 | B2 * | 9/2017 | Blanc | A63B 69/36 |
| 9,805,231 | B2 | 10/2017 | Savarese et al. | |
| 9,999,821 | B2 | 6/2018 | Yarmis et al. | |
| 10,078,953 | B2 | 9/2018 | Savarese et al. | |
| 10,254,139 | B2 | 4/2019 | Martin et al. | |
| 11,666,811 | B2 | 6/2023 | Kondo et al. | |
| 2009/0233735 | A1 * | 9/2009 | Savarese | G08B 21/0266 473/407 |

(Continued)

*Primary Examiner* — Nini F Legesse
(74) *Attorney, Agent, or Firm* — NEO IP

(57) ABSTRACT

A housing assembly for golf swing sensing electronics that includes one or more sensors, such as accelerometers, gyrometers, or others, a battery, a threaded bottom plastics assembly that attaches to the grip end of a golf club, a plastic overmold, and an anti-rotation washer that secures the housing assembly, thus preventing dislodgement and/or rotation during use.

20 Claims, 14 Drawing Sheets

(56) References Cited

U.S. PATENT DOCUMENTS

| | | | | |
|---|---|---|---|---|
| 2012/0295726 | A1* | 11/2012 | Cherbini | G09B 19/0038 473/409 |
| 2015/0231478 | A1* | 8/2015 | Boggs | A63B 53/10 473/223 |
| 2017/0312572 | A1* | 11/2017 | Thornton | A63B 69/3632 |
| 2019/0051136 | A1 | 2/2019 | Savarese et al. | |
| 2019/0176004 | A1* | 6/2019 | Dingman | A63B 60/14 |

* cited by examiner

ROTATIONALLY FIXED HOUSING FOR MULTI-AXIS MOTION SENSING, TELEMETRY, PROCESSING AND OTHER ELECTRONIC COMPONENTS OPERABLE TO SECURELY AFFIX TO A GOLF CLUB

BACKGROUND OF THE INVENTION

1. Field of the Invention

The present invention relates to a housing for a golf sensor and more specifically to a housing for a sensor attached to a golf club in a manner that fixes geometric orientation of the golf sensor and prevents rotation during swinging and striking motions.

2. Description of the Prior Art

It is generally known in the prior art to provide tag devices including motion sensors attachable to a golf club for detecting swing parameters, and for those tag devices to include housings for attaching to the golf club.

Prior art patent documents include the following:

US Patent Publication No. 2019/0051136 for Golf Club Apparatuses And Methods by inventors Savarese et al, filed Aug. 21, 2018, and published Feb. 14, 2019, describes methods and systems for managing golf clubs and for collecting golf data, such as golf strokes. In one embodiment, a golf data collection system includes a golf accessory worn on the golfer's wrist, such as a watch, equipped with a GPS receiver, impact sensing and motion sensing means, and a transceiver to communicate with golf club tags (e.g. at 2.4 GHz such as Bluetooth). The golf accessory senses the motion of the golf club being swung by the golf and/or senses the impact of the golf club striking the golf ball. When swinging motion or impact is sensed the device uses the transceiver to communicate with golf club tags. The closest golf club (i.e. the club in the golfer's hand during the swing) is captured as the club used by the swing based on RSSI (Received Signal Strength Indicator). Other embodiments are also described.

U.S. Pat. No. 9,999,821 for Method for Monitoring Performance Characteristics Associated with User Activities Involving Swinging Instruments by inventors Yarmis et al, filed Jul. 13, 2016, and issued Jun. 19, 2018, discloses methods for attachment of devices to a swinging instrument, the devices generally including a cover, a base, a chassis, and positive and negative electrical contacts. The base includes a fastening portion and a support portion. The chassis supports a printed circuit board. The devices include a cap configured and dimensioned to mate relative to the support portion of the base. The support portion can support the chassis, the printed circuit board, the positive and negative electrical contacts, and the cap. The cover can be configured and dimensioned to detachably interlock relative to the base. In the mated configuration, the cap and the base can form a battery opening configured and dimensioned to receive therethrough a battery.

U.S. Pat. No. 9,805,231 for Golf Data Collection System with RFID in Golf Club by inventors Savarese et al, filed Mar. 12, 2014, and issued Oct. 31, 2017, describes a golf data collection system using a near field communication system to record golf club identifiers and golf strokes at GPS-identified positions.

U.S. Pat. No. 9,694,263 for Golf Club Grip with User Notification and Tracking Capability by inventors Savarese et al, filed Jan. 29, 2016, and issued Jul. 4, 2017, describes methods and apparatuses related to golf club grips with attached or embedded RFID tags. In an embodiment, a RFID tag is attached to or embedded into a golf club grip and a RFID reader incorporated into a personal computing device may read or capture information associated with the RFID tag. The device may be configured to provide notifications to the golfer based on the captured information.

U.S. Pat. No. 9,643,049 for Shatter Proof Enclosure and Mount for a Motion Capture Element by inventors Bentley et al, filed Feb. 8, 2016, and issued May 9, 2017, discloses a shatter proof enclosure and mount for a motion capture element that couples to equipment, where the enclosure and optionally the mount is shatter proof or shatter resistant. Exposed areas of the enclosure or mount or both that are subject to impact may be covered with a protective layer that prevents fragments of the enclosure or internal components from exiting the layer, even in the event of an impact. For example, the protective layer may incorporate flexible materials such as silicone rubber. Alternatively, the protective layer may be rigid but effectively unbreakable, using materials such as polycarbonate. The protective layer may also include a mesh that prevents internal components from existing the enclosure.

U.S. Pat. No. 9,452,330 for Golf Club Grip with User Notification and Tracking Capability by inventors Savarese et al, filed Jan. 10, 2014, and issued Sep. 27, 2016, describes methods and apparatuses related to golf club grips with attached or embedded RFID tags. In an embodiment, a RFID tag is attached to or embedded into a golf club grip and a RFID reader incorporated into a personal computing device may read or capture information associated with the RFID tag. The device may be configured to provide notifications to the golfer based on the captured information.

U.S. Pat. No. 9,412,979 for Device for Monitoring Performance Characteristics Associated with User Activities Involving Swinging Instruments by inventors Yarmis et al, filed May 8, 2014, and issued Aug. 9, 2016, is directed to devices for attachment to a swinging instrument that generally include a cover, a base, a chassis, and positive and negative electrical contacts. The base includes a fastening portion and a support portion. The chassis supports a printed circuit board. The devices include a cap configured and dimensioned to mate relative to the support portion of the base. The support portion can support the chassis, the printed circuit board, the positive and negative electrical contacts, and the cap. The cover can be configured and dimensioned to detachably interlock relative to the base. In the mated configuration, the cap and the base can form a battery opening configured and dimensioned to receive therethrough a battery. Exemplary embodiments are also directed to methods of device assembly.

U.S. Pat. No. 9,211,455 for Golf Club Grip with RFID Assembly by inventors Savarese et al, filed Dec. 20, 2013, and issued Dec. 15, 2015, describes methods and apparatuses related to golf club grips with attached or embedded RFID tags. In an embodiment, a RFID tag is attached to or embedded into a golf club grip in a manner that does not compromise either the functionality or aesthetics of the grip. In an embodiment, the embedded or attached RFID tag is located in the butt-end of the grip, perpendicular to the shaft of the golf club.

U.S. Pat. No. 9,195,781 for Golf Club Apparatuses and Methods by inventors Savarese et al, filed Oct. 2, 2012, and issued Nov. 24, 2015, details methods and systems for managing golf clubs and collecting golf data, such as golf strokes. In one embodiment, a golf data collection system includes a golf accessory worn on the golfer's wrist, such as a watch, equipped with a GPS receiver, impact sensing and motion sensing means, and a transceiver to communicate with golf club tags (e.g. at 2.4 GHz such as Bluetooth). The golf accessory senses the motion of the golf club being swung by the golf and/or senses the impact of the golf club striking the golf ball. When swinging motion or impact is sensed the device uses the transceiver to communicate with golf club tags. The closest golf club (i.e. the club in the golfer's hand during the swing) is captured as the club used by the swing based on RSSI (Received Signal Strength Indicator). Other embodiments are also described.

U.S. Pat. No. 9,033,810 for Motion Capture Element Mount by inventor Bentley, filed Jul. 26, 2011, and issued May 19, 2015, describes enabling coupling or retrofitting a golf club with active motion capture electronics that are battery powered, passive or active shot count components, for example a passive RFID, and/or a visual marker on the cap for use with visual motion capture cameras. Does not require modifying the golf club. Electronics package and battery can be easily removed and replaced, for example without any tools. May utilize a weight that is removed when inserting the electronic package in the mount, wherein the weight element may have the same weight as an electronics package, for no net change or minimal change in club weight. May be implemented with a shaft enclosure and expander that may be coupled with a screw aligned along an axis parallel to the axis of the golf club shaft. May utilize non-permanently and/or friction coupling between the mount and golf club shaft. Cap may include a visual marker and/or logo.

U.S. Pat. No. 9,028,337 for Motion Capture Element Mount by inventor Bentley, filed Nov. 29, 2011, and issued May 12, 2015, describes enabling coupling or retrofitting a golf club with active motion capture electronics that are battery powered, passive or active shot count components, for example a passive RFID, and/or a visual marker on the cap for use with visual motion capture cameras. Does not require modifying the golf club. Electronics package and battery can be easily removed and replaced, for example without any tools. May utilize a weight that is removed when inserting the electronic package in the mount, wherein the weight element may have the same weight as an electronics package, for no net change or minimal change in club weight. May be implemented with a shaft enclosure and expander that may be coupled with a screw aligned along an axis parallel to the axis of the golf club shaft. May utilize non-permanently and/or friction coupling between the mount and golf club shaft. Cap may include a visual marker and/or logo.

U.S. Pat. No. 8,926,444 for Golf Club by inventors Kato et al, filed Apr. 25, 2013, and issued Jan. 6, 2015, details a golf club having a head disposed at a front end of a shaft and having a grip disposed at a back end of the shaft. The golf club includes a sensor section arranged on a grip-end edge of the grip and used for analyzing action of a golf swing.

U.S. Pat. No. 8,894,502 for Apparatus for Housing Telemetry, Sensing, Processing, and Other Electronic Components and Affixing Such Apparatus to a Golf Club by inventor Rose, filed Sep. 14, 2011, and issued Nov. 25, 2014, discloses a housing for a sensor including the sensor; vertical walls surrounding an aperture containing the sensor; a horizontal floor connected to a bottom of the vertical walls, the floor having the sensor located thereon; and a vertical shaft connected to the bottom of the floor and configured to connect the housing to a grip of a golf club. The shaft and at least the horizontal floor define a continuous air passage to vent air pressure from an inside of the golf club to an outside of the golf club.

U.S. Pat. No. 11,666,811 for Swing Measuring Attachment, and Swing Measuring Apparatus by inventors Kondo et al, filed Mar. 24, 2021, and issued Jun. 6, 2023, discloses a swing measuring attachment including a base portion and a protrusion protruding from the base portion. The protrusion is provided with a screw thread, and it includes a projection at the front end of the protrusion.

U.S. Pat. No. 10,254,139 for Method of Coupling a Motion Sensor to a Piece of Equipment by inventors Martin et al, filed May 3, 2017, and issued Apr. 9, 2019, describes a method for coupling a sensor to a piece of equipment, such as a golf club, baseball bat, or tennis racket, that ensures that the sensor is in a known position and orientation relative to the equipment. Compensates and calibrates for degrees of freedom introduced in manufacturing and installation. The method may include manufacturing a sensor receiver that aligns with equipment in a fixed orientation, and that holds a sensor housing in a fixed orientation relative to the receiver. Remaining uncertainties in sensor position and orientation may be addressed using post-installation calibration. Calibration may include performing specific calibration movements with the equipment and analyzing the sensor data collected during these calibration movements.

U.S. Pat. No. 10,078,953 for Golf Club Apparatuses and Methods by inventors Savarese et al, filed Nov. 9, 2015, and issued Sep. 18, 2018, details methods and systems for managing golf clubs and for collecting golf data, such as golf strokes. In one embodiment, a golf data collection system includes a golf accessory worn on the golfer's wrist, such as a watch, equipped with a GPS receiver, impact sensing and motion sensing means, and a transceiver to communicate with golf club tags (e.g. at 2.4 GHz such as Bluetooth). The golf accessory senses the motion of the golf club being swung by the golf and/or senses the impact of the golf club striking the golf ball. When swinging motion or impact is sensed the device uses the transceiver to communicate with golf club tags. The closest golf club (i.e. the club in the golfer's hand during the swing) is captured as the club used by the swing based on RSSI (Received Signal Strength Indicator). Other embodiments are also described.

SUMMARY OF THE INVENTION

The present invention relates to a housing for a golf sensor and more specifically to a housing for a sensor attached to a golf club in a manner that fixes geometric orientation of the golf sensor and prevents rotation during swinging and striking motions.

It is an object of this invention to provide golf tag housings for detecting golf swing parameters that do not dislodge or change orientation during use.

In one embodiment, the present invention is directed to a tag device, including a sensor base, including one or more sensors configured to produce sensor data tracking movement of a golf club and a protrusion configured to screw into a hole of a grip end of a golf club, an overmold configured to mate with a top of the sensor base, and an anti-rotation washer positioned between the sensor base and the grip end of the golf club, including a disk and one or more claws extending downwardly from the disk, configured to embed in the hole in the grip end of the golf club, wherein the one or more sensors include at least one photosensor, and wherein the overmold is substantially transparent or translucent.

In another embodiment, the present invention is directed to a tag device, including a sensor base, including one or more sensors configured to produce sensor data tracking movement of a golf club and a protrusion configured to screw into a hole of a grip end of a golf club, an overmold configured to mate with a top of the sensor base, and an anti-rotation washer positioned between the sensor base and the grip end of the golf club, including a disk and one or more claws extending downwardly from the disk, configured to embed in the hole in the grip end of the golf club, wherein the disk of the anti-rotation washer includes one or more ridges or valleys configured to mate with one or more ridges or valleys in a bottom surface of the sensor base, and wherein the anti-rotation washer includes one or semi-circular protrusions extending radially outwardly from the disk, configured to frictionally engage with an interior surface of the overmold.

In yet another embodiment, the present invention is directed to a tag device, including a sensor base, including one or more sensors configured to produce sensor data tracking movement of a golf club and a protrusion configured to screw into a hole of a grip end of a golf club, an overmold configured to mate with a top of the sensor base, and an anti-rotation washer positioned between the sensor base and the grip end of the golf club, including a disk and one or more claws extending downwardly from the disk, configured to embed in the hole in the grip end of the golf club, wherein a lower lip of the overmold is configured to engage a top edge of the sensor base in an interference fit, and wherein the interference fit is watertight.

These and other aspects of the present invention will become apparent to those skilled in the art after a reading of the following description of the preferred embodiment when considered with the drawings, as they support the claimed invention.

DETAILED DESCRIPTION

Figure 1A:
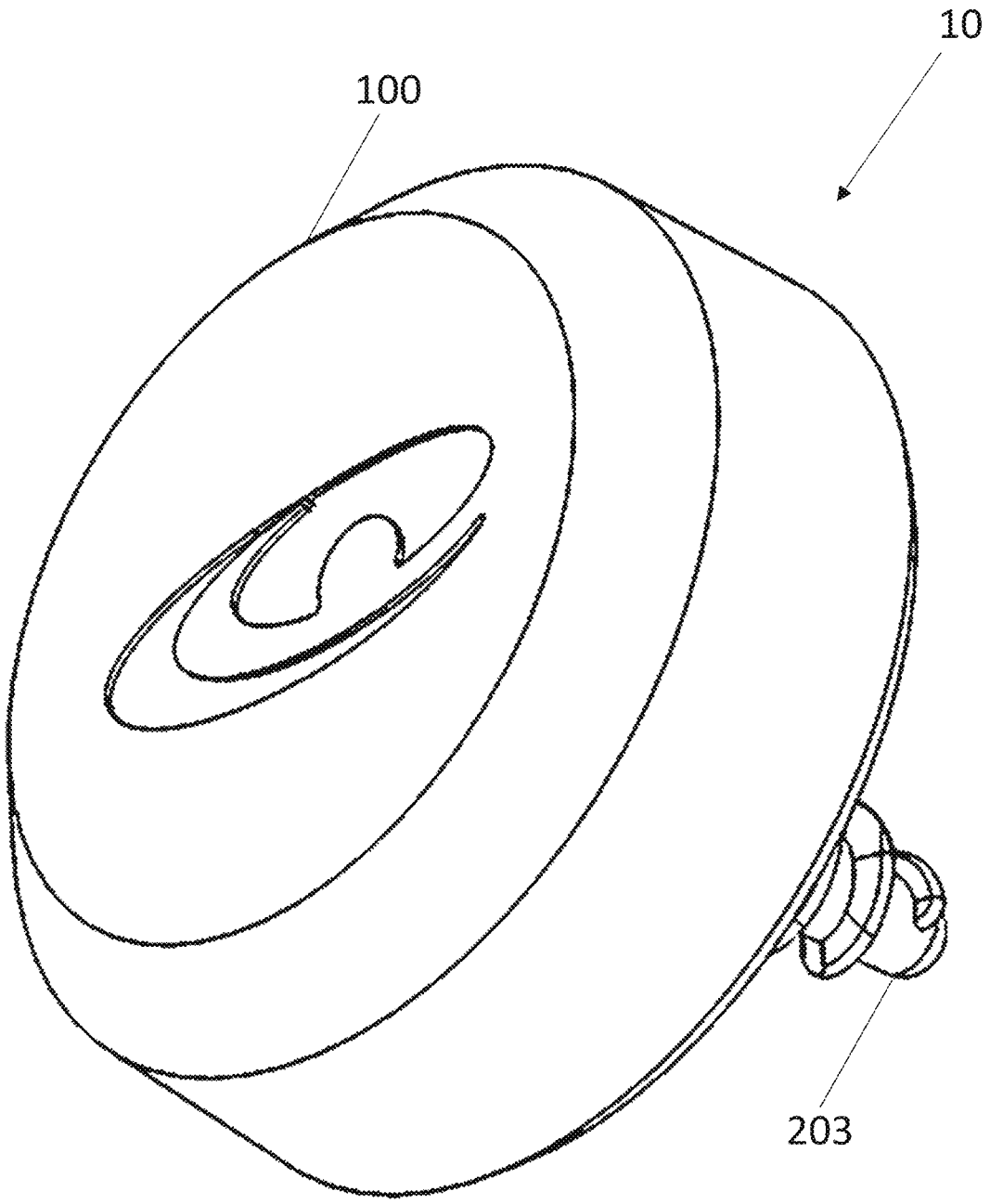
FIG. 1A illustrates a perspective view of a sensor device within a housing according to one embodiment of the present invention.

The present invention is generally directed to a housing for a golf sensor and more specifically to a housing for a sensor attached to a golf club in a manner that fixes geometric orientation of the golf sensor and prevents rotation during swinging and striking motions.

In one embodiment, the present invention is directed to a tag device, including a sensor base, including one or more sensors configured to produce sensor data tracking movement of a golf club and a protrusion configured to screw into a hole of a grip end of a golf club, an overmold configured to mate with a top of the sensor base, and an anti-rotation washer positioned between the sensor base and the grip end of the golf club, including a disk and one or more claws extending downwardly from the disk, configured to embed in the hole in the grip end of the golf club, wherein the one or more sensors include at least one photosensor, and wherein the overmold is substantially transparent or translucent.

In another embodiment, the present invention is directed to a tag device, including a sensor base, including one or more sensors configured to produce sensor data tracking movement of a golf club and a protrusion configured to screw into a hole of a grip end of a golf club, an overmold configured to mate with a top of the sensor base, and an anti-rotation washer positioned between the sensor base and the grip end of the golf club, including a disk and one or more claws extending downwardly from the disk, configured to embed in the hole in the grip end of the golf club, wherein the disk of the anti-rotation washer includes one or more ridges or valleys configured to mate with one or more ridges or valleys in a bottom surface of the sensor base, and wherein the anti-rotation washer includes one or semi-circular protrusions extending radially outwardly from the disk, configured to frictionally engage with an interior surface of the overmold.

In yet another embodiment, the present invention is directed to a tag device, including a sensor base, including one or more sensors configured to produce sensor data tracking movement of a golf club and a protrusion configured to screw into a hole of a grip end of a golf club, an overmold configured to mate with a top of the sensor base, and an anti-rotation washer positioned between the sensor base and the grip end of the golf club, including a disk and one or more claws extending downwardly from the disk, configured to embed in the hole in the grip end of the golf club, wherein a lower lip of the overmold is configured to engage a top edge of the sensor base in an interference fit, and wherein the interference fit is watertight.

Optimizing a golf swing requires a high level of biomechanical precision. The key parameters of a golf swing include, among other things, the plane on which the club is swung, the angle of the club face, the path of the swing, the directional angle of the club shaft throughout the swing, and the speed of the hands and the clubhead during the swing.

Various devices (referred to herein as "club tags') that typically include such components as accelerometers, gyros, piezo sensors and other sensors, are able to be attached to a golf club and measure and even recreate a golf swing so that it is able to be analyzed and improved upon. Additionally, club tags, such as those described in U.S. patent application Ser. No. 18/538,679, which is incorporated herein by reference in its entirety, are able to detect whether a golf swing has occurred, thus making scoring and data collection easier and less intrusive in the actual play of the game. These applications describe club tags that collect data and provide the data to the golfer. The club tags include sensors that are contained within a housing which is affixed to the grip end of the club. These sensors collect data while a golfer takes a golf swing and then provide the data to the golfer thereafter so the golfer is able to improve their swing. The sensors collect precision angular motion data based on the position and motion of the golf club through space, for instance, whether the golf club face angle is open or closed at a given point during the golf swing. In order to attach to a golf club, the housing of the club tags frequently include a threaded shaft which is screwed into a hole in the end of the grip. The housing is also sometimes vented to release pressure waves. However, the significant stresses on the golf club during the swing, vibrations and rotational forces from the club motion, ball strike, and or ground strike often cause the housing to dislodge and rotate, which negatively impacts the accuracy and precision of the angular motion data, or leads to loss of the club tag entirely in the event that it detaches mid-swing.

Thus, there is a need for a club tag housing apparatus that houses and protects the swing analysis and detection electronics, securely fastens the club tag to a golf club and remains securely fastened in a consistent orientation, without becoming dislodged and/or rotating during the rigors of the golf swing, and which is unobtrusive to the golfer.

Referring now to the drawings in general, the illustrations are for the purpose of describing one or more preferred embodiments of the invention and are not intended to limit the invention thereto.

The exemplary motion sensing device electronics that are housed within the components of the current invention include components configured to detect the angular motion and status of a golf club and/or the characteristics of a swing of the golf club (e.g., photosensors, accelerometers, gyroscopes, piezoelectric sensors, magnetometers, etc. and associated electronics), process swing data (e.g., processors, micro controllers, finite state machines, etc.), and transmit data from the apparatus to another computing device. One of ordinary skill in the art will understand that the tag device used with the housing of the present invention, and the specific sensors and sensor orientations within the tag device are not intended to be limiting and the housing with anti-rotation features disclosed herein are compatible with a plurality of types of tags.

Figure 1B:
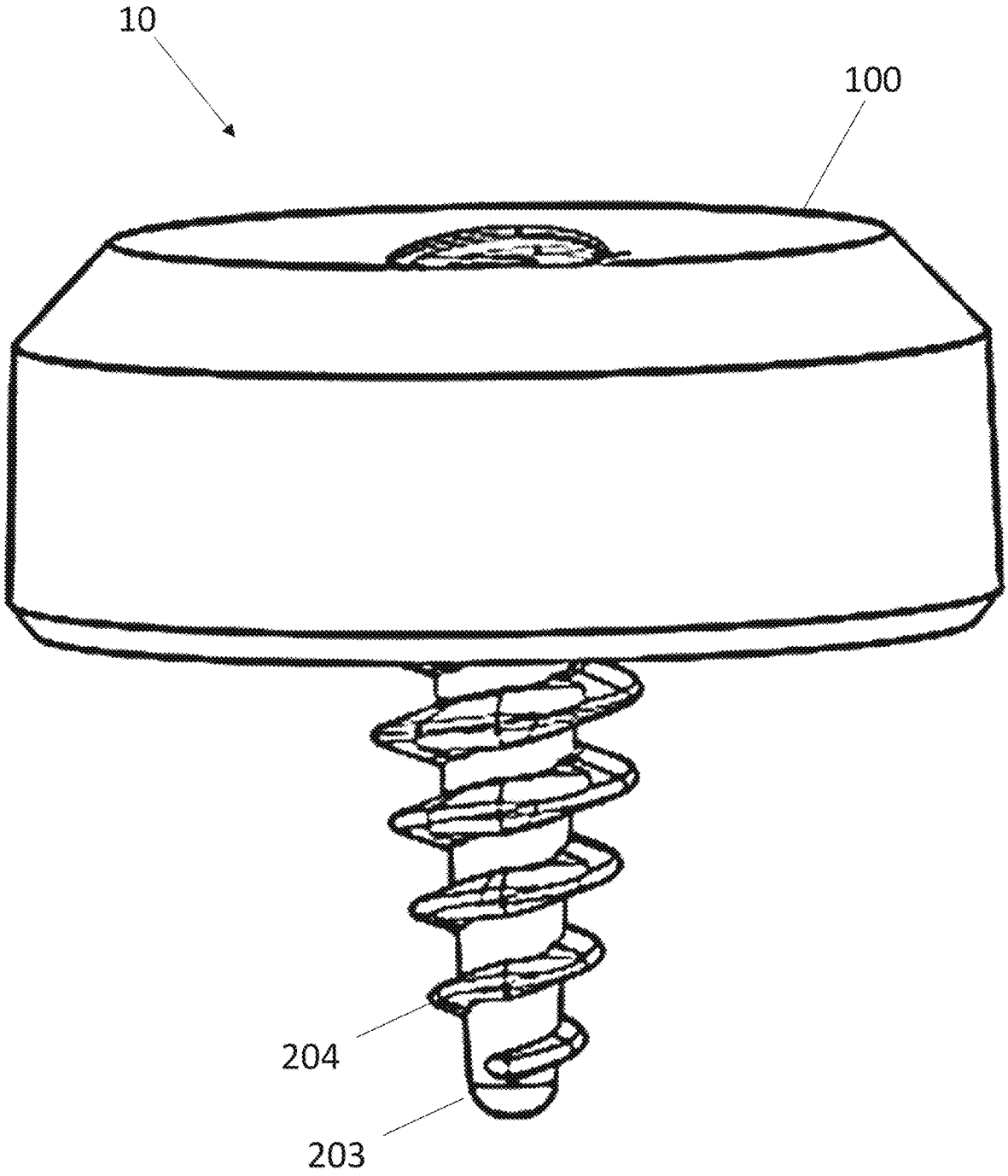
FIG. 1B illustrates an additional perspective view of a sensor device within a housing according to one embodiment of the present invention.
Figure 1C:
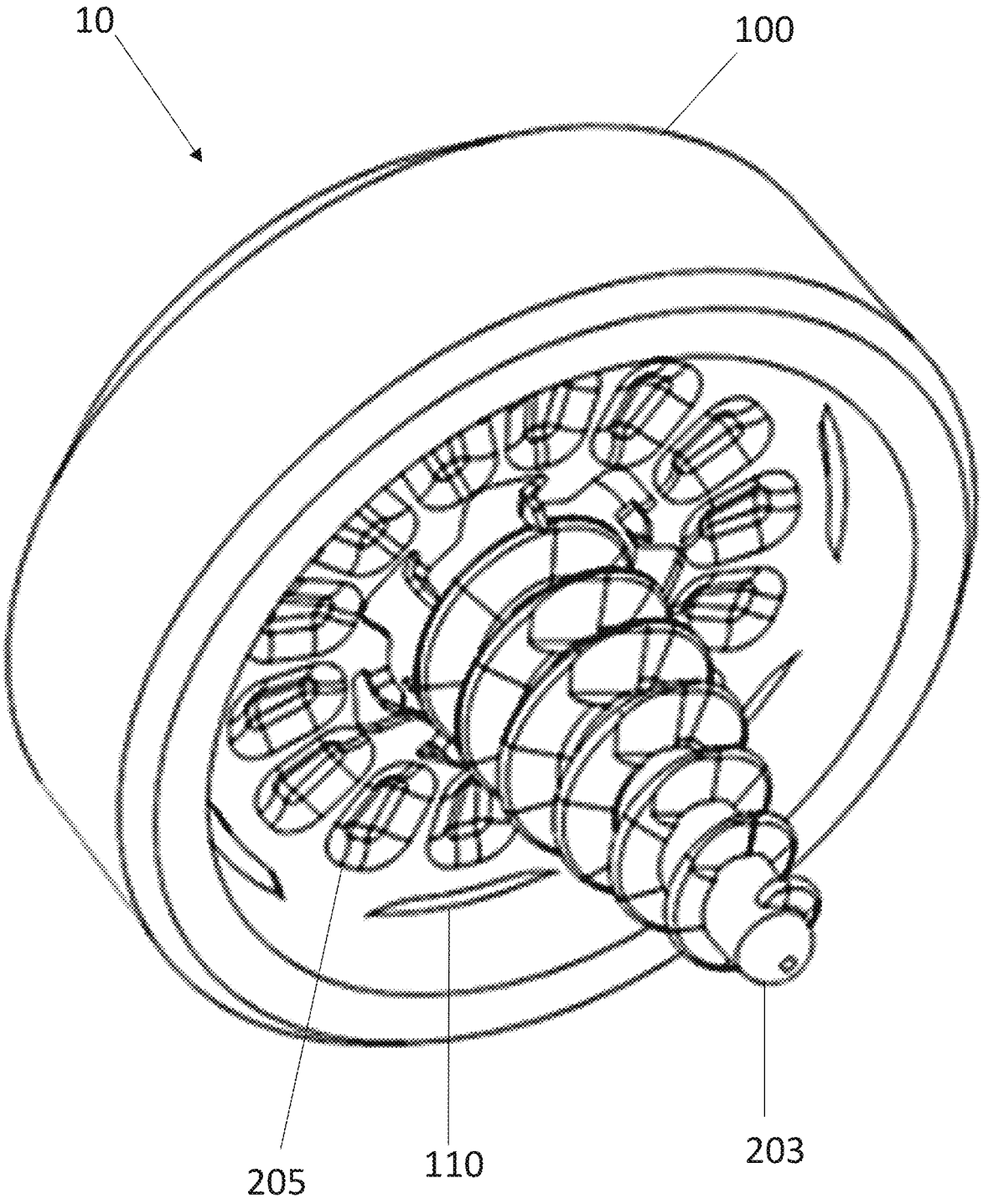
FIG. 1C illustrates an additional perspective view of a sensor device within a housing according to one embodiment of the present invention.

FIGS. 1A-1C illustrate a sensor device within an overmold according to one embodiment of the present invention. A tag device 10 includes an overmold 100 attached to a sensor device, where the sensor device includes a post 203 for attaching to an end of a golf club. The post 203 includes threads 204, allowing the tag device to be effectively screwed into the golf club. In order to prevent rotation between the tag device 10 and the golf club after attachment, an anti-rotation washer is placed between the tag device 10 and the golf club. As shown in FIG. 1C, the bottom of the sensor device includes one or more ridges 205 configured to mate with valleys defined in the top of the anti-rotation washer. Furthermore, in one embodiment, the bottom of the sensor device and/or the interior edges of the overmold 100 include one or more notches configured to accept portions of the circumference of the anti-rotation washer, to ensure strong attachment between the overmold 100, sensor device, and washer.

Figure 2A:
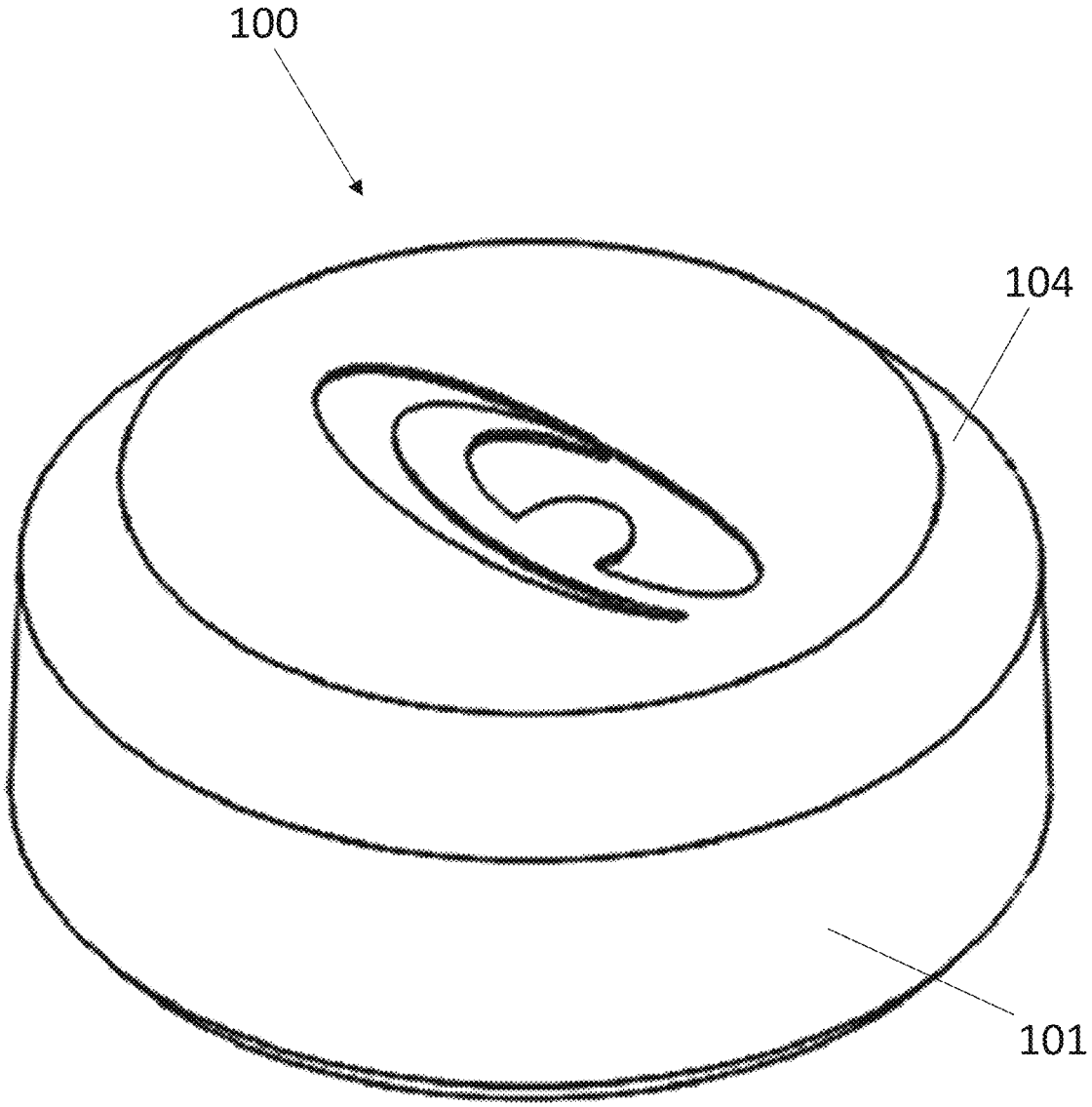
FIG. 2A illustrates a top perspective view of an overmold for a sensor device housing according to one embodiment of the present invention.
Figure 2B:
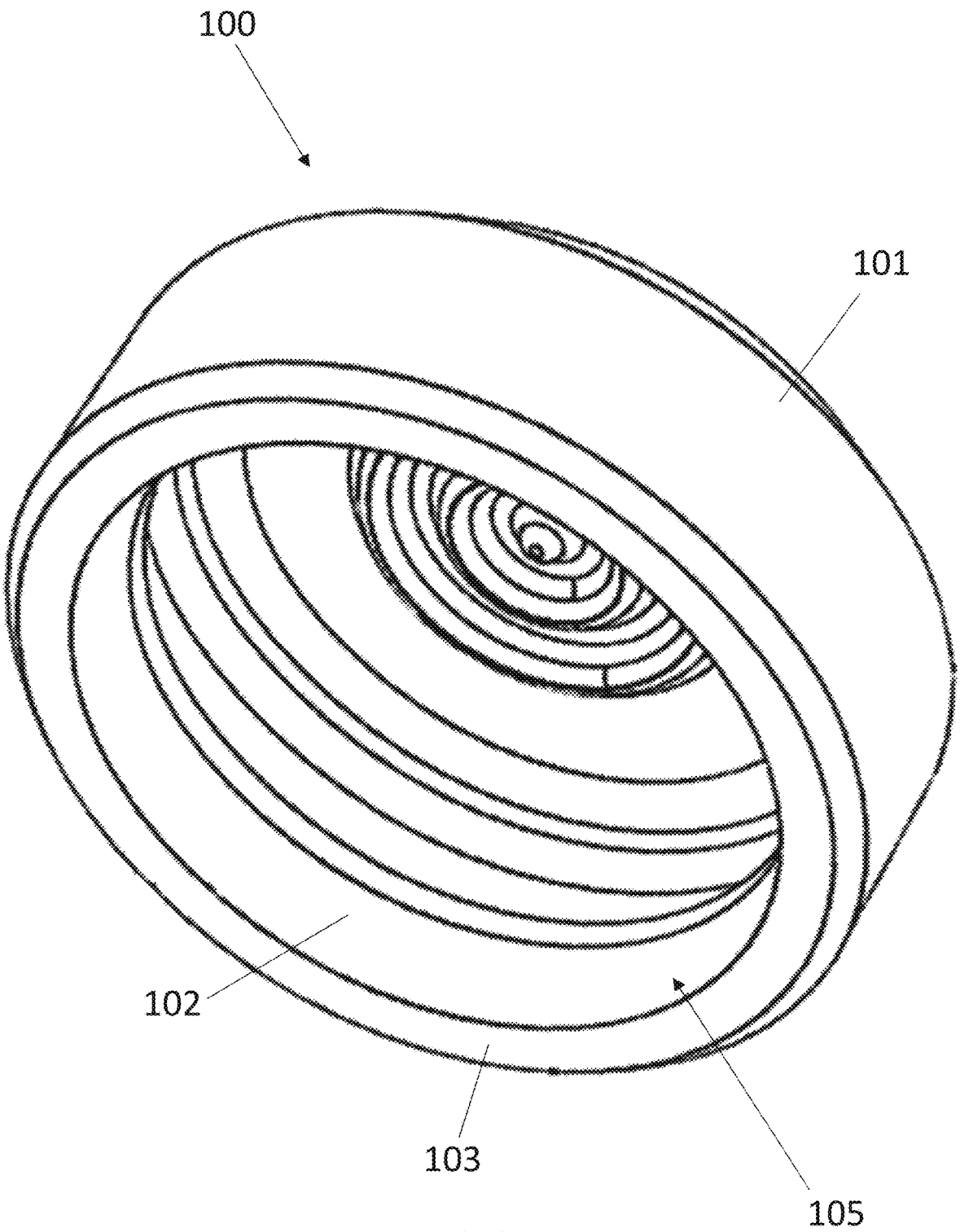
FIG. 2B illustrates a bottom perspective view of an overmold for a sensor device according to one embodiment of the present invention.

FIGS. 2A and 2B illustrate an overmold for a sensor device housing according to one embodiment of the present invention. In one embodiment, the plastic overmold 100 includes a cup having a circular cross-section, with parallel internal sides 102 and external sides 101. In one embodiment, the plastic overmold 100 includes a flat beveled edge 104 around the upper circumference of the overmold 100. The depth of the internal cavity 105 is such that it houses the sensor device without interference from top features of the sensor device or the battery of the sensor device. In one embodiment, the plastic overmold 100 is formed from a molded translucent thermoplastic material of a thickness allowing enough light to pass through the beveled edge 104 to activate a photo sensor of the sensor device, as shown in FIG. 5B, when the sensor device is out of a golf bag and exposed to light. The plastic overmold 100 is preferably formed from a thermoplastic material that has a hardness providing flexibility to install and remove the plastic overmold 100 from the sensor device during assembly and/or during battery replacement. The interior diameter of the overmold 100 and the configuration of the bottom lip 103 is configured such that there is an interference fit with an external top edge of the sensor device, forming a watertight seal around the motion sensing electronics, PCB, Battery, photosensor, and/or other components of the sensor device.

Figure 3:
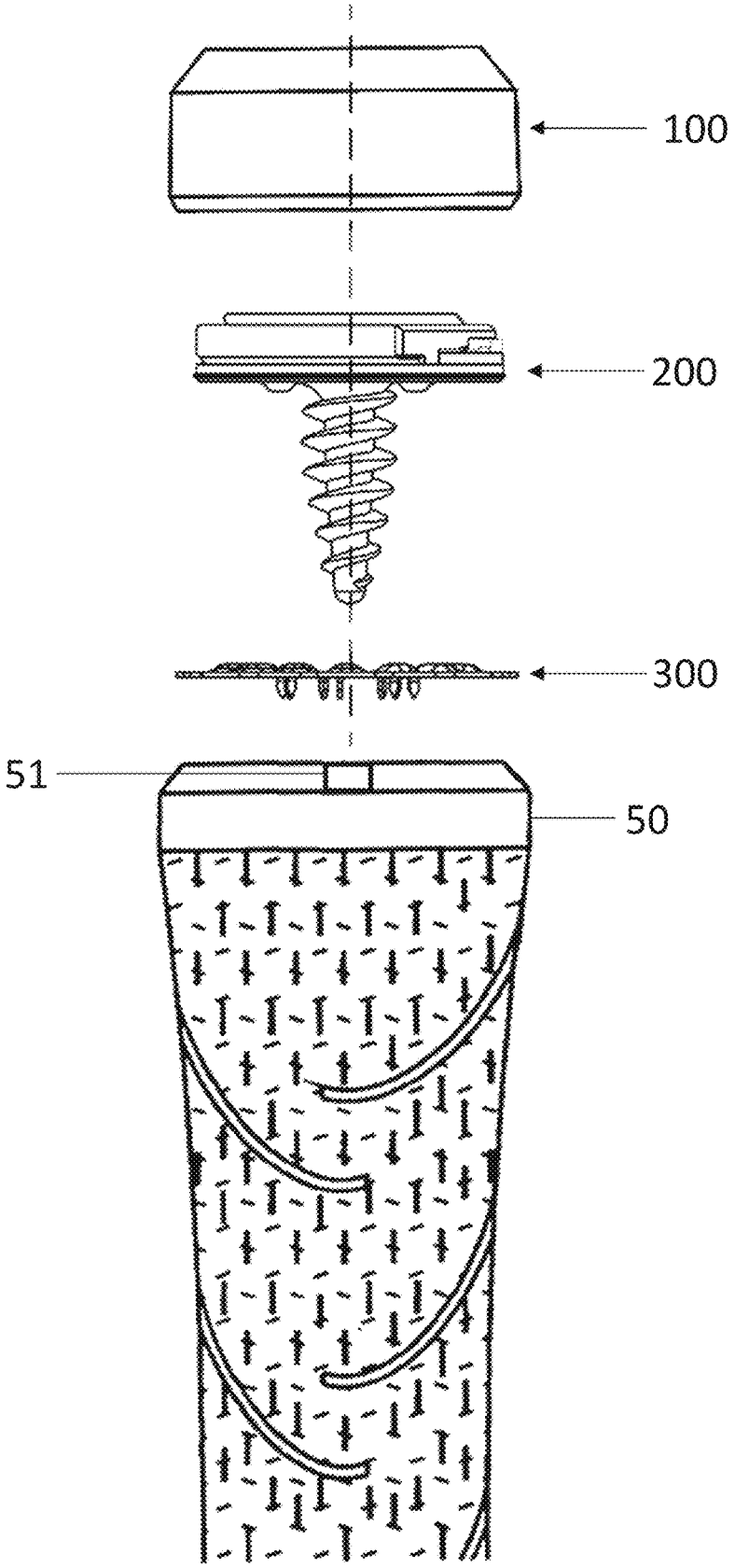
FIG. 3 illustrates a side exploded view of a sensor device and a housing attached to a golf club according to one embodiment of the present invention.
Figure 4:
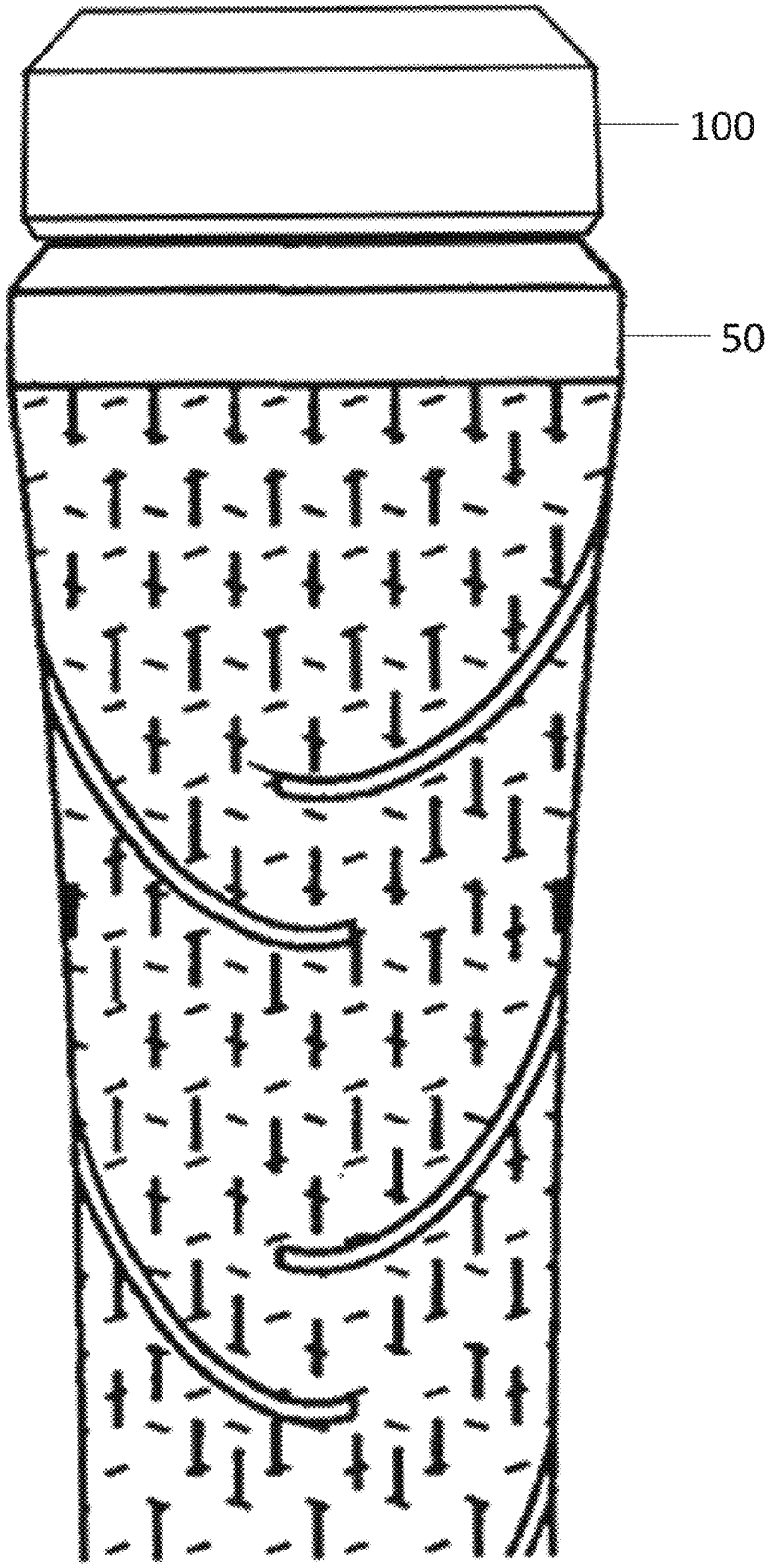
FIG. 4 illustrates a side orthogonal view of a sensor device and a housing attached to a golf club according to one embodiment of the present invention.

FIG. 3 illustrates an exploded view of an embodiment of the major components of the current invention as they are stacked (assembled) and attached to the grip end of a golf club 50. The plastic overmold 100 is snapped over top of the edge of a sensor device 200 to form the protective housing of an exemplary motion sensing device. The anti-rotation washer 300 is placed between the bottom of the sensor device 200 of the exemplary motion sensing device and the grip end of the golf club 50. A threaded post of the sensor device 200 engages hole 51 in the grip end of the golf club 50. The plastic overmold 100 of the assembled exemplary motion sensing device is turned in a clockwise direction to mate the bottom of the sensor device 200 with the anti-rotation washer 300 and to embed claws of the anti-rotation washer 300 into the grip end of the golf club 50. The overmold 100 over the sensor device is shown attached to the golf club in FIG. 4.

Figure 5A:
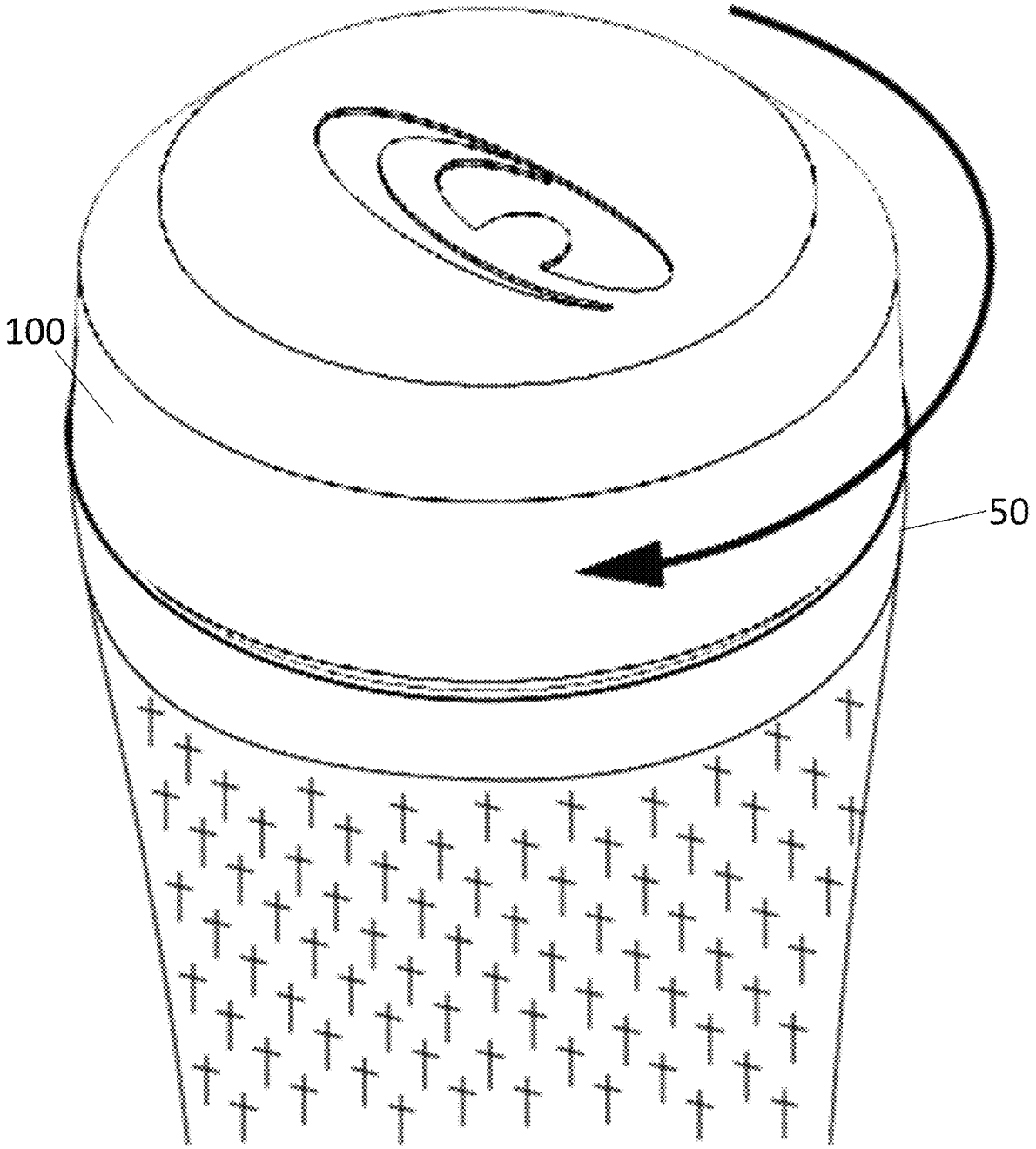
FIG. 5A illustrates a perspective view of a sensor device and a housing attached to a golf club, demonstrating torque limiting capabilities of the housing according to one embodiment of the present invention.
Figure 5B:
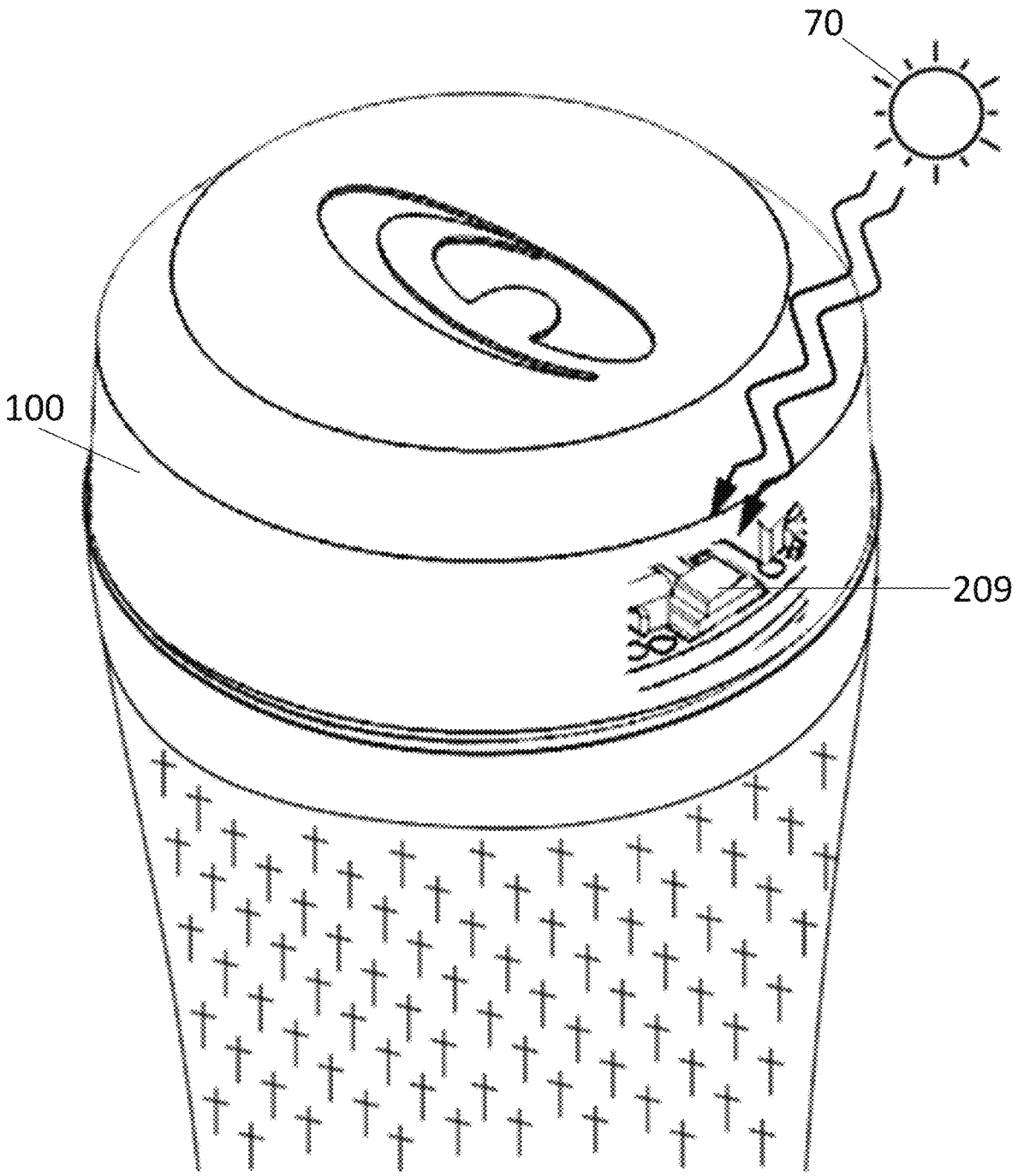
FIG. 5B illustrates a perspective sectional view of a sensor device and a housing attached to a golf club, showing activation of a photosensitive component according to one embodiment of the present invention.

FIG. 5A illustrates a perspective view of a sensor device and a housing attached to a golf club, demonstrating torque limiting capabilities of the housing according to one embodiment of the present invention. An important aspect of the present invention is the torque control/limiting feature provided by the design and interference fit of the plastic overmold 100 to the sensor device and the inclusion of an anti-rotation washer between the sensor device and the golf club 50. The combination of the materials and design configuration of these components produces a watertight interference fit between the plastic overmold 100 and the sensor device that applies a certain measure of resistance to turning of the plastic overmold 100 around the sensor device within the range required to ensure an adequate mechanical connection between the washer and the sensor device and between claws of the washer with the grip end of the golf club 50 when the overmold 100 is rotated in the clockwise direction as shown in FIG. 5A.

FIG. 5B illustrates a perspective sectional view of a sensor device and a housing attached to a golf club, showing activation of a photosensitive component according to one embodiment of the present invention. Advantageously, the present invention allows for photosensing or even photovoltaic cell charging even when the overmold is attached to the sensor device, allowing the sensor device to continue functioning as needed while being protected. In one embodiment, the overmold 100 is formed from a transparent or translucent material, allowing light waves in the proper spectrum from a light source 70 (e.g., solar light) to pass through the walls and the flat beveled edge of the plastic overmold 100 and activate a photosensor 209 and supporting electronics of the sensor device. In one embodiment, the overmold material is selectively translucent such that it only allows light at one or more specifically tuned frequencies or wavelengths that the photosensor 209 and/or one or more solar cells of the sensor device are configured to receive, thus allowing the sensor device to determine if the device is in a light or dark condition.

Figure 6A:
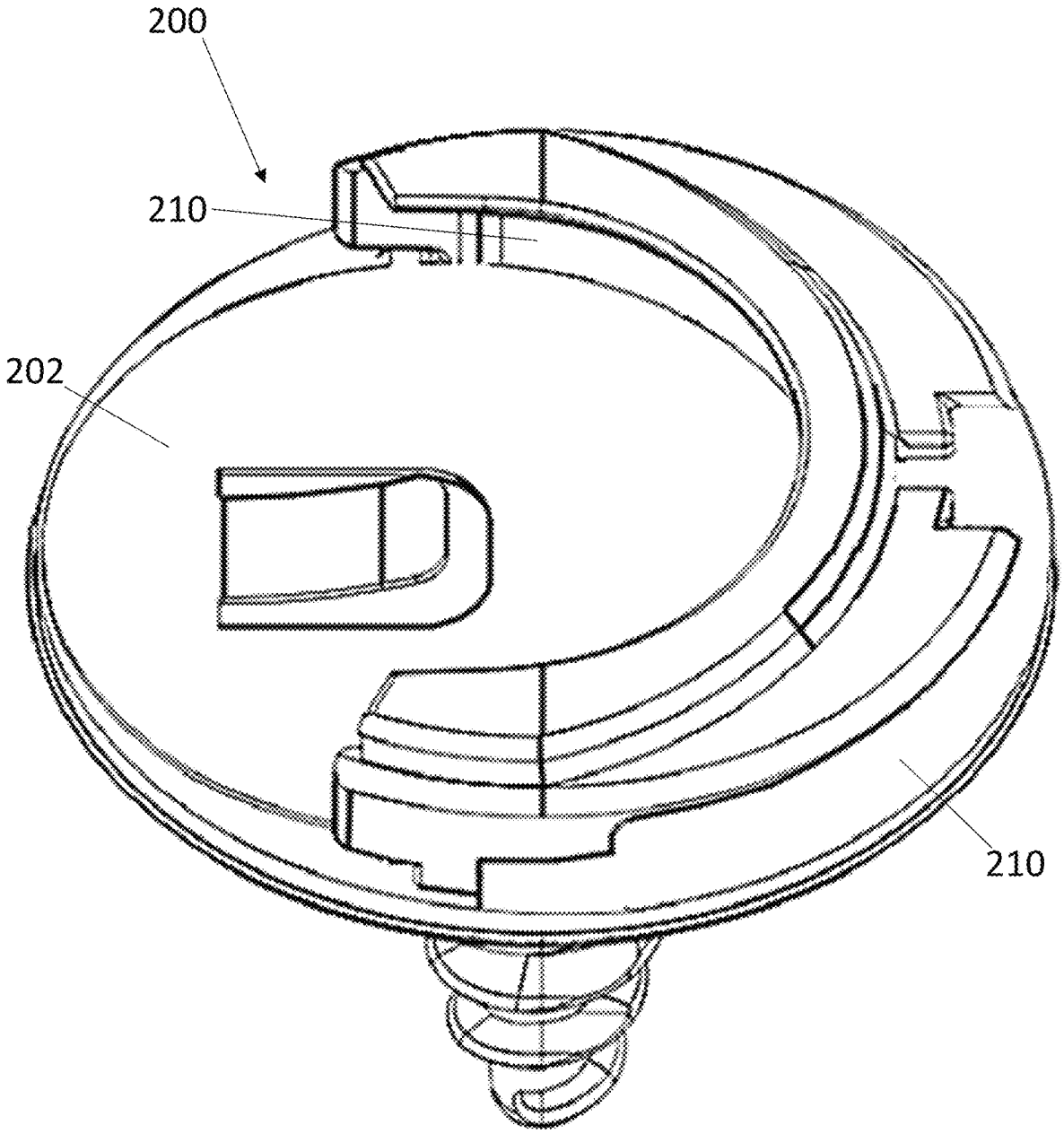
FIG. 6A illustrates a top perspective view of a sensor device housing according to one embodiment of the present invention.
Figure 6B:
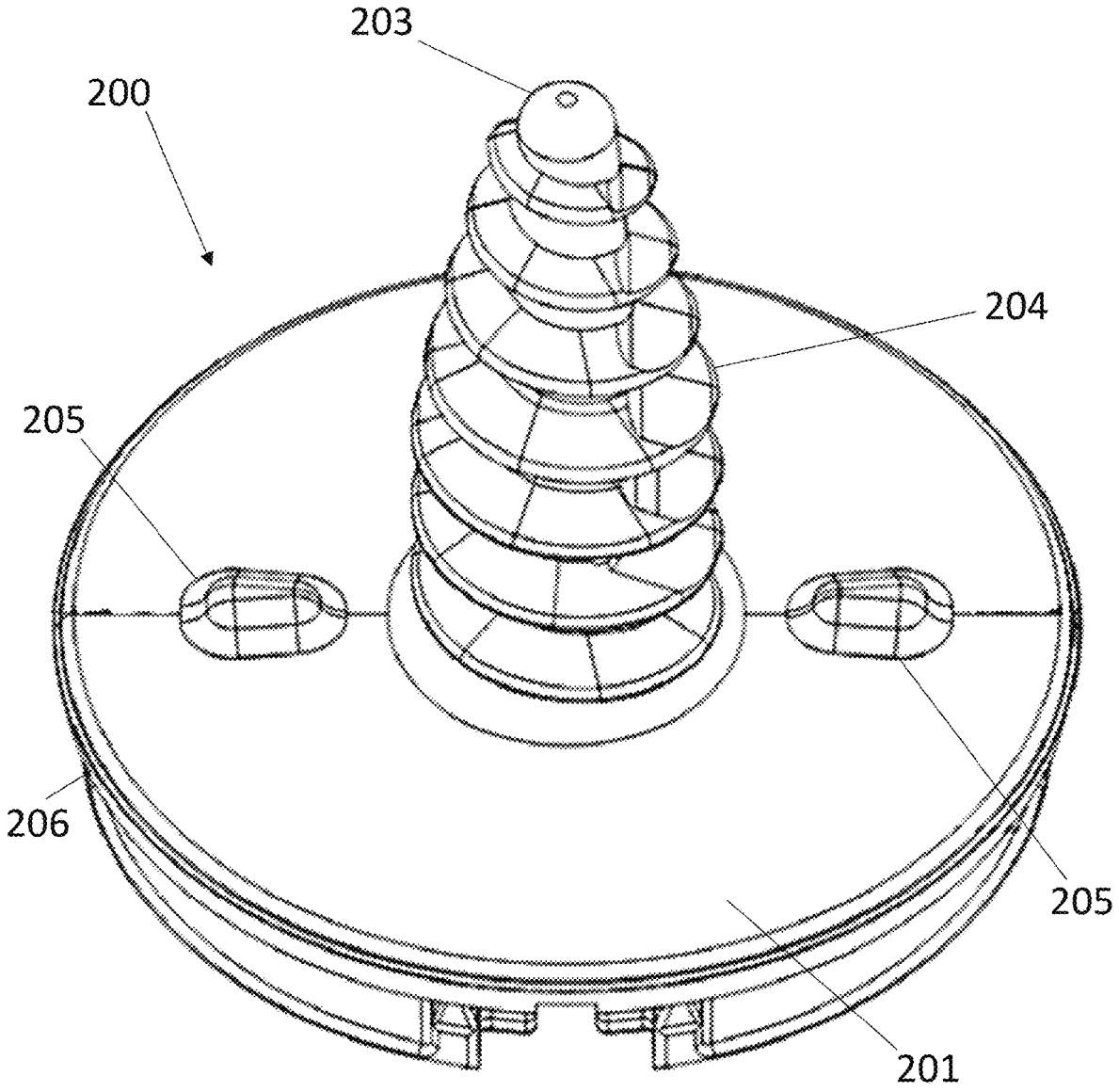
FIG. 6B illustrates a bottom perspective view of a sensor device housing according to one embodiment of the present invention.
Figure 7:
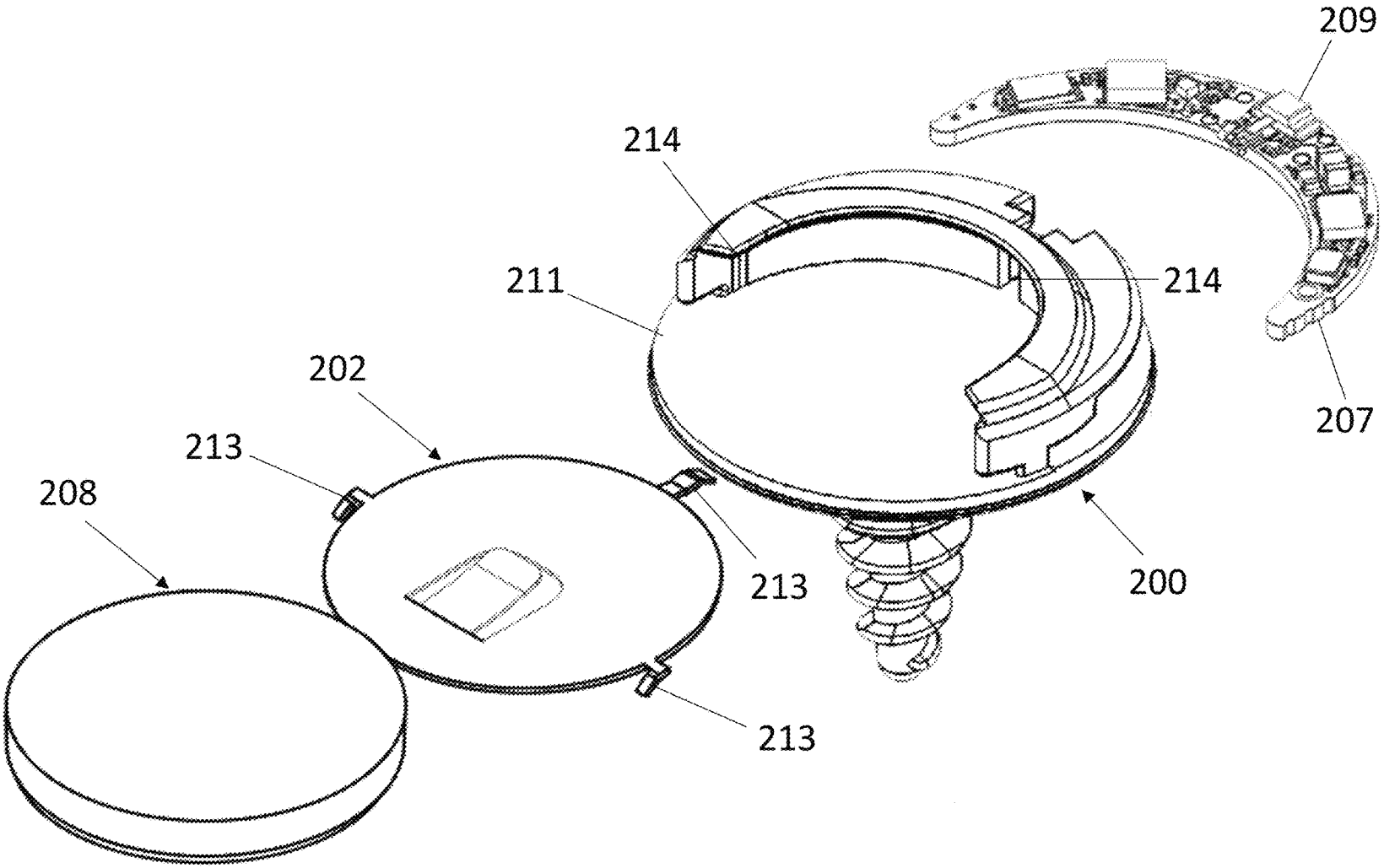
FIG. 7 illustrates a perspective exploded view of a threaded base assembly for a sensor device according to one embodiment of the present invention.

FIGS. 6A and 6B illustrates a sensor device housing according to one embodiment of the present invention. In one embodiment, a sensor device 200 includes a circular platform 202 with cavities designed to house and secure a battery backplane 210, containing a battery and the electronics PCB, as shown in FIG. 7. A vertical post 203 extends downwardly from a bottom surface 201 of the sensor device 200. The vertical post 203 includes threads 204 configured to engage with a hole in the grip end of a golf club and, when turned in a clockwise direction, create a secure connection without damaging the grip end of the golf club, allowing the sensor device 200 to essentially be screwed into the end of the golf club. The circumference and thickness of the circular platform 202 are configured to provide a watertight interference fit with the plastic overmold 100 that rotates with a given resistance that contributes to the torque control/limiting characteristics of the present invention. The bottom surface 201 of the circular platform 202 includes one or more ridges 205 configured to interface with the ridges and valleys on the top surface of an anti-rotation washer. In one embodiment, the circular platform 202 includes fewer ridges than the top surface of the anti-rotation washer, the same number of ridges as the anti-rotation washer, or more ridges than the anti-rotation washer. When the threads 204 of the exemplary motion sensing device are engaged in the hole of the grip end and rotated in a clockwise direction, the ridges 205 of the threaded platform click over top of the ridges of the anti-rotation washer while transferring most of the force in a downward direction to embed claws of the washer into the top surface of the grip end of the golf club. When the sensor device 200 is secure, the claws of the anti-rotation washer are fully engaged and the ridges 205 of the threaded bottom assembly are fully seated in the valleys of the anti-rotation washer. If the sensor device 200 is turned in a clockwise direction any further, the torque control/limiting design of the current invention allows the plastic overmold 100 to continue turning around the circumference of the threaded base assembly, without turning the sensor device 200 relative to the golf club end, as an indication that installation is complete.

FIG. 7 illustrates a perspective exploded view of a threaded base assembly for a sensor device according to one embodiment of the present invention. The present invention includes three main components that are stacked and assembled to house the electronics (i.e., sensors, batteries, etc.) of the sensor device 200. The sensor device 200 includes a circular platform 202 placed atop a base 211. In one embodiment, the circular platform 202 includes one or more prongs 213 extending outwardly from the circumference of the circular platform 202. In one embodiment, the one or more prongs 213 are configured to fit within corresponding notches 214 in a battery backplane extending upwardly from the base 211. In one embodiment, the battery backplane includes one or more compartments configured to house a PCB 207 and one or more sensors 209 (e.g., a photosensor) of the sensor device 200. The bottom surface of the threaded bottom plastic assembly 200 includes a post with threads for connecting the sensor device 200 to the grip end of a golf club. In one embodiment, the battery 208 is configured to fit over the circular platform 202 until it abuts the battery backplane extending upwardly from the base 211.

Figure 8:
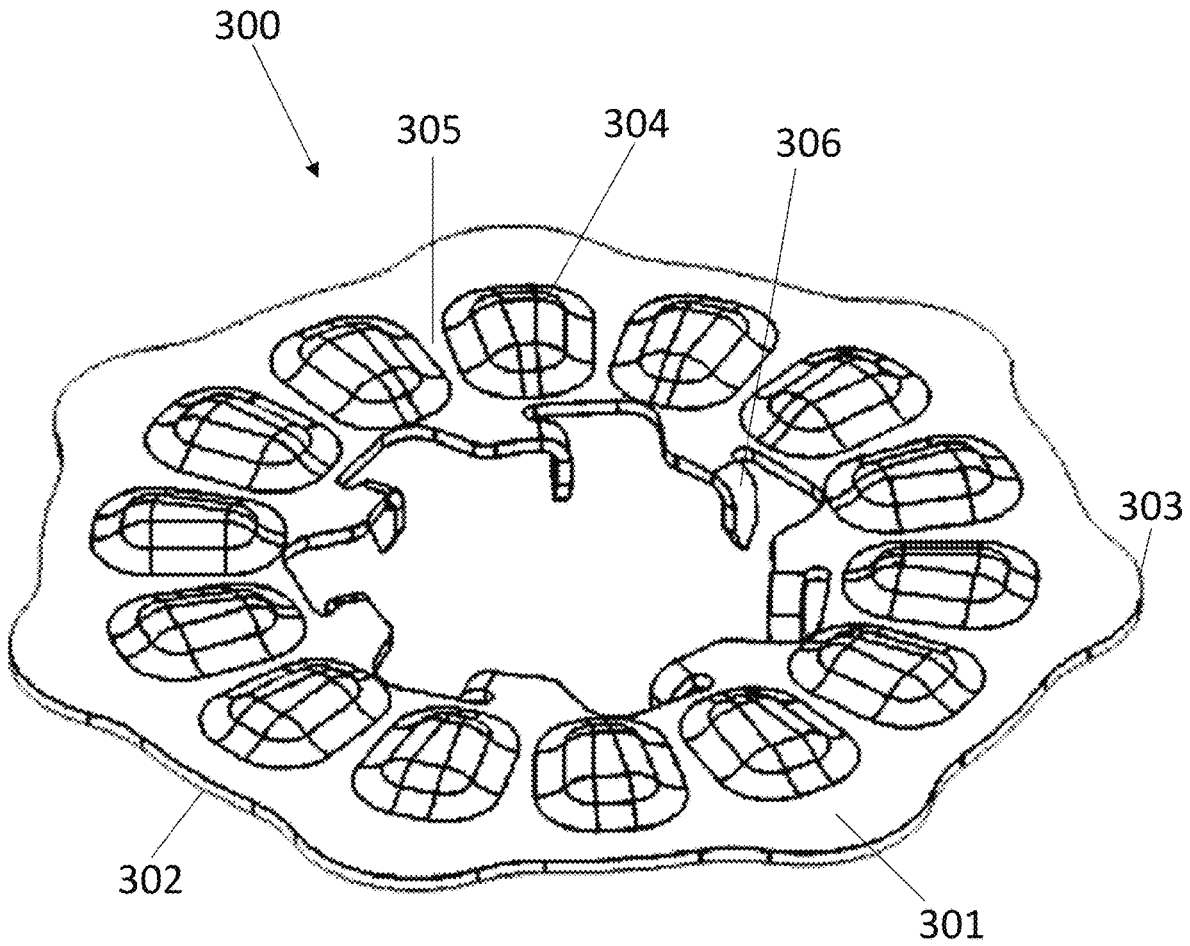
FIG. 8 illustrates a perspective view of an anti-rotation washer according to one embodiment of the present invention.

FIG. 8 illustrates a perspective view of an anti-rotation washer according to one embodiment of the present invention. In one embodiment, an anti-rotation washer 300 includes a disk 301 having heptagonal cutouts 302 along the circumference of the disk 301 that reduce the contact surface to seven semi-circular protrusions 303 around the perimeter which are designed to make contact with the plastic overmold 100. In this embodiment, the disk 301 is therefore substantially heptagonal with semi-circular protrusions 303 blunting each corner of the heptagon. However, one of ordinary skill in the art will understand that the disk is not limited to a particular polygon in shape and that, by way of example and not limitation, hexagonal, octagonal, pentagonal, and/or other shapes are also compatible with the present invention. The contact between the overmold 100 and the semi-circular protrusions 303 creates just enough friction to hold the anti-rotation washer 300 in place while the sensor device is placed on the grip end of the golf club.

The top surface of the disk 301 contains a specified number of valleys 304 and ridges 305 having slopes, heights, widths, and radii configured to engage ridges of the sensor device allowing the sensor device to rotate until the claws 306 of the washer 300 are embedded in the golf club and the sensor device is secure. One of ordinary skill in the art will understand that the particular number, relative size, and/or shape of the valleys 304 and ridges 305 shown in FIG. 8 are not intended to be limiting according to the present invention are able to be altered so long as there is still a matching fit between the valleys 304 of the washer 300 and the ridges of the sensor device. One of ordinary skill in the art will understand that, in an alternative embodiment, the sensor device includes one or more depressions, or valleys, configured to matingly fit ridges of the anti-rotation washer 300.

The disk 301 includes an interior cut out. In one embodiment, the interior cut out is concentric with the outer circumference of the disk 301. In one embodiment, as shown in FIG. 8, the interior cut out is a heptagonal cut out, or otherwise shaped to have an equivalent number of sides to the outer circumference of the disk 301. However, one of ordinary skill in the art will understand that the interior cut out is not limited to a heptagonal shape, nor is it limited to necessarily having the same number of sides as the outer circumference of the disk 301. A plurality of claws 306 extend downwardly from sides of the interior cut out of the disk 301 and are configured to engage with the grip end of a golf club. Preferably, the lengths of the plurality of claws 306 are configured to be short enough such that the claws will only engage with the grip end of the golf club when the sensor device is substantially fully screwed into the grip end of the golf club. The engagement of the claws 306 with the golf club therefore prevents rotational movement of the sensor device in either direction during use of the golf club. One of ordinary skill in the art will understand that the specific number of the claws 306 extending from the anti-rotation washer 300 is not intended to be limiting according to the present invention. In one embodiment, the washer 300 is formed, at least in part or in full, from stainless steel.

In one embodiment, the sensors included in the sensor device include at least one of: an accelerometer, a gyroscope, a piezo sensor, a photosensor, and/or a magnetometer. Exemplary sensor devices compatible with the present invention include, but are not limited to, those described in U.S. patent application Ser. No. 18/538,679, which is incorporated herein by reference in its entirety. In one embodiment, the sensor device is configured to communicate sensor data to at least one user device for analyzing, by way of example and not limitation, a golf shot, a golf swing, and/or other aspects related to golf play.

Figure 9:
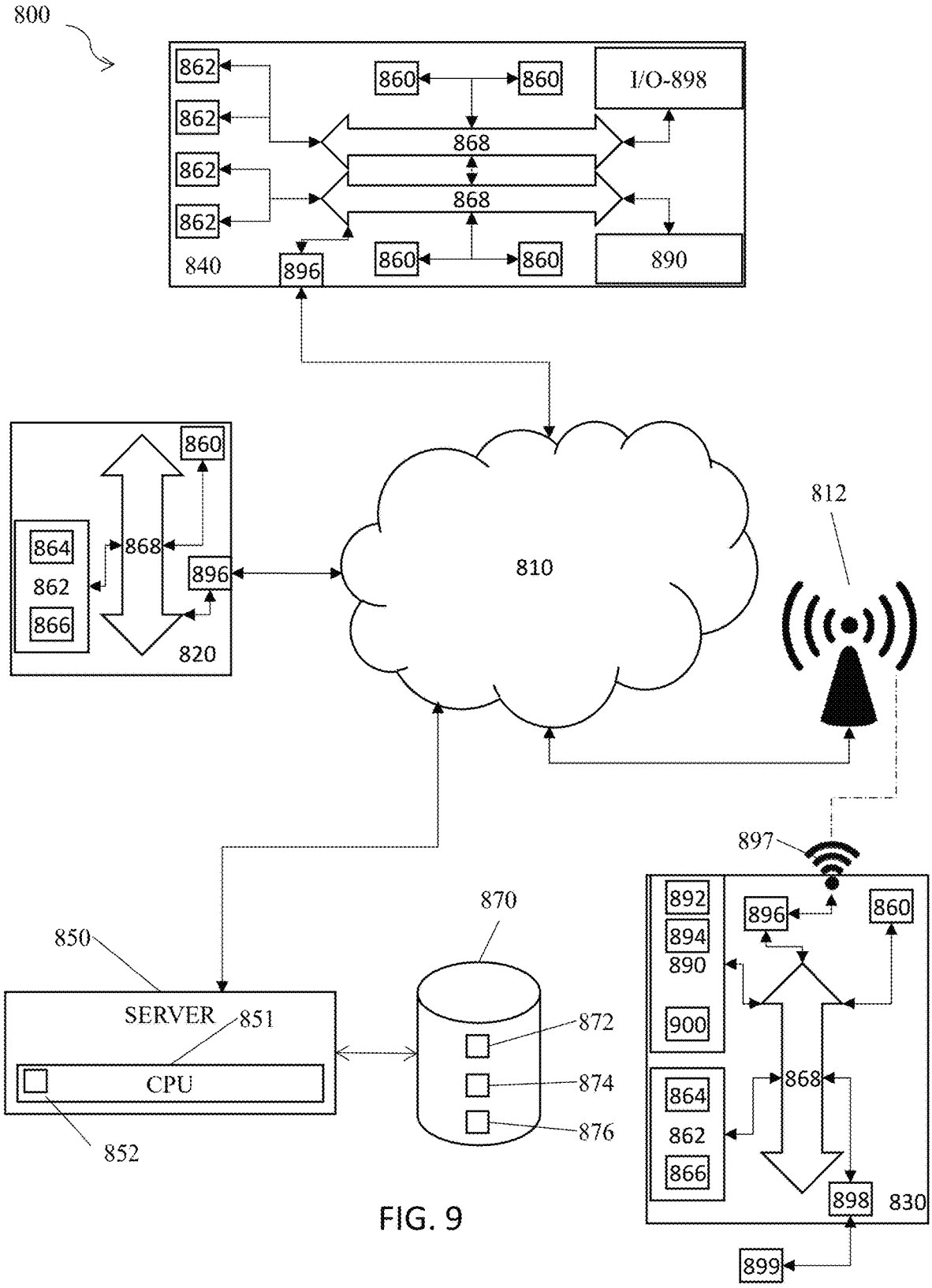
FIG. 9 is a schematic diagram of a system of the present invention.

FIG. 9 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, gaming controllers, joy sticks, touch pads, signal generation devices (e.g., speakers), augmented reality/virtual reality (AR/VR) devices (e.g., AR/VR headsets), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 9, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 9, is operable to include other components that are not explicitly shown in FIG. 9, or is operable to utilize an architecture completely different than that shown in FIG. 9. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A tag device, comprising:

a sensor base, including one or more sensors configured to produce sensor data tracking movement of a golf club and a protrusion configured to screw into a hole of a grip end of a golf club;

an overmold configured to mate with a top of the sensor base; and an anti-rotation washer positioned between the sensor base and the grip end of the golf club, including a disk and one or more claws extending downwardly from the disk, configured to embed in the hole in the grip end of the golf club;

wherein the one or more sensors include at least one photosensor; and wherein the overmold is substantially transparent or translucent.

2. The tag device of claim 1, wherein the anti-rotation washer includes one or semi-circular protrusions extending radially outwardly from the disk, configured to frictionally engage with an interior surface of the overmold.

3. The tag device of claim 1, wherein the disk of the anti-rotation washer includes one or more ridges or valleys configured to mate with one or more ridges or valleys in a bottom surface of the sensor base.

4. The tag device of claim 1, wherein the overmold is selectively tuned to allow passage of one or more selected wavelengths of light.

5. The tag device of claim 1, wherein a lower lip of the overmold is configured to engage a top edge of the sensor base in an interference fit, and wherein the interference fit is watertight.

6. The tag device of claim 1, wherein the one or more sensors further include at least one accelerometer, at least one gyroscope, at least one piezo sensor, and/or at least one magnetometer.

7. The tag device of claim 1, wherein an outer circumference of the disk of the anti-rotation washer is substantially heptagonal.

8. The tag device of claim 1, wherein the protrusion is threaded.

9. A tag device, comprising:

a sensor base, including one or more sensors configured to produce sensor data tracking movement of a golf club and a protrusion configured to screw into a hole of a grip end of a golf club;

an overmold configured to mate with a top of the sensor base; and an anti-rotation washer positioned between the sensor base and the grip end of the golf club, including a disk and one or more claws extending downwardly from the disk, configured to embed in the hole in the grip end of the golf club;

wherein the disk of the anti-rotation washer includes one or more ridges or valleys configured to mate with one or more ridges or valleys in a bottom surface of the sensor base; and wherein the anti-rotation washer includes one or semi-circular protrusions extending radially outwardly from the disk, configured to frictionally engage with an interior surface of the overmold.

10. The tag device of claim 9, wherein the one or more sensors include at least one photosensor.

11. The tag device of claim 9, wherein the overmold is substantially transparent or translucent.

12. The tag device of claim 11, wherein the overmold is selectively tuned to allow passage of one or more selected wavelengths of light.

13. The tag device of claim 9, wherein a lower lip of the overmold is configured to engage a top edge of the sensor base in an interference fit, and wherein the interference fit is watertight.

14. The tag device of claim 9, wherein the one or more sensors include at least one accelerometer, at least one gyroscope, at least one piezo sensor, and/or at least one magnetometer.

15. The tag device of claim 9, wherein an outer circumference of the disk of the anti-rotation washer is substantially heptagonal.

16. The tag device of claim 9, wherein the protrusion is threaded.

17. A tag device, comprising:

a sensor base, including one or more sensors configured to produce sensor data tracking movement of a golf club and a protrusion configured to screw into a hole of a grip end of a golf club;

an overmold configured to mate with a top of the sensor base; and an anti-rotation washer positioned between the sensor base and the grip end of the golf club, including a disk and one or more claws extending downwardly from the disk, configured to embed in the hole in the grip end of the golf club;

wherein a lower lip of the overmold is configured to engage a top edge of the sensor base in an interference fit, and wherein the interference fit is watertight.

18. The tag device of claim 17, wherein the one or more sensors include at least one photosensor.

19. The tag device of claim 17, wherein the overmold is substantially transparent or translucent.

20. The tag device of claim 17, wherein the disk of the anti-rotation washer includes one or more ridges or valleys configured to mate with one or more ridges or valleys in a bottom surface of the sensor base.

* * * * *